US006267522B1

(12) United States Patent
Slippy et al.

(10) Patent No.: US 6,267,522 B1
(45) Date of Patent: Jul. 31, 2001

(54) MEDIA HOLDING APPARATUS, MEDIA SIZE DETECTOR AND METHOD FOR DETECTING SIZE OF MEDIA FOR A DOCUMENT-GENERATING DEVICE

(75) Inventors: Jamison B. Slippy, Middleton; Robert W. Jewell, Boise; Paul R. Spencer, Meridian, all of ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/294,829

(22) Filed: Apr. 19, 1999

(51) Int. Cl.[7] ..... B41J 13/24

(52) U.S. Cl. ..... 400/708.1; 101/232; 200/61.61; 200/61.58 R; 271/265.01

(58) Field of Search ..... 400/624, 703, 400/707.1, 708, 708.1; 226/15; 33/784; 338/176; 364/478.01; 702/155; 271/265.01; 101/232; 355/311; 200/61.61, 61.58 R

(56) References Cited

U.S. PATENT DOCUMENTS 4,054,251 * 10/1977 Henderson et al. ..... 226/15
4,680,570 * 7/1987 Hel ..... 338/776
5,029,402 * 7/1991 Lazecki et al. ..... 33/784
5,483,889 1/1996 Hoberock et al. ..... 101/232
5,822,223 * 10/1998 Genest ..... 702/155
5,940,106 * 8/1999 Walker ..... 347/104
5,961,226 * 10/1999 Nishida ..... 400/708
5,988,905 * 11/1999 Abe et al. ..... 400/708

* cited by examiner

*Primary Examiner*—Eugene Eickholt

(57) ABSTRACT

A media holding apparatus includes a tray having a support surface configured to receive media and a media stop carried by the tray. The media stop is movably supported for continuously adjustable positioning relative to the tray to conform dimensionally with media received in the tray. The apparatus also includes a position-detecting sensor associated with the tray and the media stop which is operative to generate a unique electrical pattern corresponding with a detected position of the media stop relative to the tray. The unique electrical pattern is indicative of the size of the media detected in the tray. A method is also provided.

12 Claims, 7 Drawing Sheets

MEDIA HOLDING APPARATUS, MEDIA SIZE DETECTOR AND METHOD FOR DETECTING SIZE OF MEDIA FOR A DOCUMENT-GENERATING DEVICE

FIELD OF THE INVENTION

This invention relates to media size detectors and media holding apparatus, and more particularly, to an automatic media size detector for detecting the size of media that is being delivered to a document-generating device, such as a printer, a copier or a facsimile machine.

BACKGROUND OF THE INVENTION

Document-generating is implemented by a number of hard copy output devices such as printers, copy machines, facsimile machines and multiple function peripheral (MFP) devices. In order to generate hard copy output, a supply of printable media needs to be made available to such devices. Typically, a stack of paper, or media, is supplied to a device from one or more removable paper trays. A host computer, or external device, submits a print, copy or facsimile job to the device which includes commands that tell the device on which size paper to print the job.

In order to determine the size of paper, or media, present within the paper tray of these devices, some technique is needed to detect the size of paper, or media, present in the supply tray.

Several techniques are known for conveying to a printing device information about the contents of a paper tray. According to one prior art technique, a uniquely sized tray is provided for each paper size that is accommodated by a printing device. For example, one tray is sized to receive letter-sized paper, while another tray is sized to receive legal-sized paper. Insertion of a specific size tray ensures only that size paper will be used. Accordingly, insertion of the specific size tray by a user notifies the user as to which sized paper is presently available. Optionally, a selection switch can be provided on the printing device that is set by a user to the paper size currently loaded in the device. Alternatively, mechanical identification features have been provided on a tray which are detected by the device once the tray is inserted, thereby identifying the specific paper size to the device. However, it is costly and inconvenient to utilize several different size trays. Additionally, storage space is needed to store the surplus trays.

According to another technique, a single paper tray can be reconfigured to receive various sizes of paper. Many home and small-business printers utilize such a single paper tray. However, re-configuration only accommodates a series of discrete paper sizes, such as letter-sized, legal-sized and A4-sized paper. Typically, a series of notches or holes is provided in the tray, and one or more media stops are positioned into a selected set of notches or holes to accommodate one of the available paper sizes. However, only a handful of predefined discrete paper sizes is available.

According to yet another technique, a single paper tray is reconfigured by a user after purchase to accommodate a single size of paper. According to such technique, the single paper tray is molded to accommodate a large selection of readily available paper sizes. The user indicates to a printer the size of paper that is present in the tray. One technique for indicating to the printer the size of paper involves "punching out" a marker or location in the paper tray corresponding to the specific paper size. A sensor detects the "punched out" marker which notifies the printer of the specific paper size. However, once punched out the tray is permanently configured for that particular paper size. The user must purchase a new tray in order to use a different paper size.

According to even another technique, U.S. Pat. No. 5,483,889 discloses an automatic media size detector for use with paper trays to detect the size of media present in a paper tray. A back stop and a side stop are each moved to unique associated receiving positions that are provided in the paper tray, with each position corresponding to a specific paper size. A plurality of conductive strips are provided in the tray, in proximity with each back stop. Each back stop, when received in an associated receiving position, makes electrical contact between a unique pair of the conductive strips so as to electrically connect the strips. The printer, using a look-up table, monitors all the strips to determine which two strips of the plurality are electrically connected together, which also indicates the received paper size. However, only a limited number of preselected paper sizes can be accommodated by such a paper tray.

Therefore, there exists a need for an improved automatic media size detector capable of detecting an infinite number of media sizes within a range of sizes. Furthermore, there is a need for an improved paper tray utilizing such a media size detector.

SUMMARY OF THE INVENTION

An apparatus and method are provided for automatically sensing media size in a hard copy output device such as a printer, a copier and a facsimile machine. A media stop is coupled with a position-detecting sensor to determine the size of media received on a support surface. According to one implementation, the support surface is provided by a paper tray. Also according to one implementation, the position-detecting sensor is formed by a voltage divider circuit, including a linear potentiometer, a conductive strip and a conductive bridge.

According to one aspect, a media holding apparatus includes a tray having a support surface configured to receive media and a media stop carried by the tray. The media stop is movably supported for continuously adjustable positioning relative to the tray to conform dimensionally with media received in the tray. The apparatus also includes a position-detecting sensor associated with the tray and the media stop which is operative to generate a unique electrical pattern corresponding with a detected position of the media stop relative to the tray. The unique electrical pattern is indicative of the size of the media detected in the tray.

According to another aspect, a media size detector for detecting the size of media that is to be delivered to a document-generating device includes a support surface configured to receive media and a media stop carried by the support surface for movable repositioning to substantially conform dimensionally with the size of the media. A position-detecting sensor is electrically coupled with the media stop and is operative to generate an electrical pattern corresponding with a detected position of the media stop relative to the support surface and indicative of a dimension of the media on the support surface.

According to yet another aspect, a method for detecting the size of media placed within a tray of a document-generating device provides a movable media stop on a support surface and a voltage divider having a bridge connection carried by the movable media stop. The method also loads media onto the support surface, moves the media stop to contain the media and to conform with a dimension of the media, and detects the size of the contained media by monitoring the voltage drop across the voltage divider to determine the position of the media stop on the support surface.

One advantage is to provide an apparatus and method for detecting the size of media present on a support surface, such as a print tray, in a manner that is not limited to a few preselected sizes. Another advantage is to provide an automatic apparatus and method for sensing media size.

DESCRIPTION OF THE DRAWINGS

Preferred embodiments of the invention are described below with reference to the following accompanying drawings depicting examples embodying the best mode for practicing the invention.

FIG. 4 is an enlarged perspective view taken from above and behind showing the construction of a media stop used on the paper tray of FIG. 1.

FIG. 6 is an enlarged perspective view taken from behind and below showing the media stop and illustrating a frictionable rubber surface pad and shoe.

FIG. 7 is a simplified schematic diagram of the media size detector used on the paper tray of FIG. 1 and showing the voltage divider circuits.

DETAILED DESCRIPTION OF THE INVENTION

Figure 1:
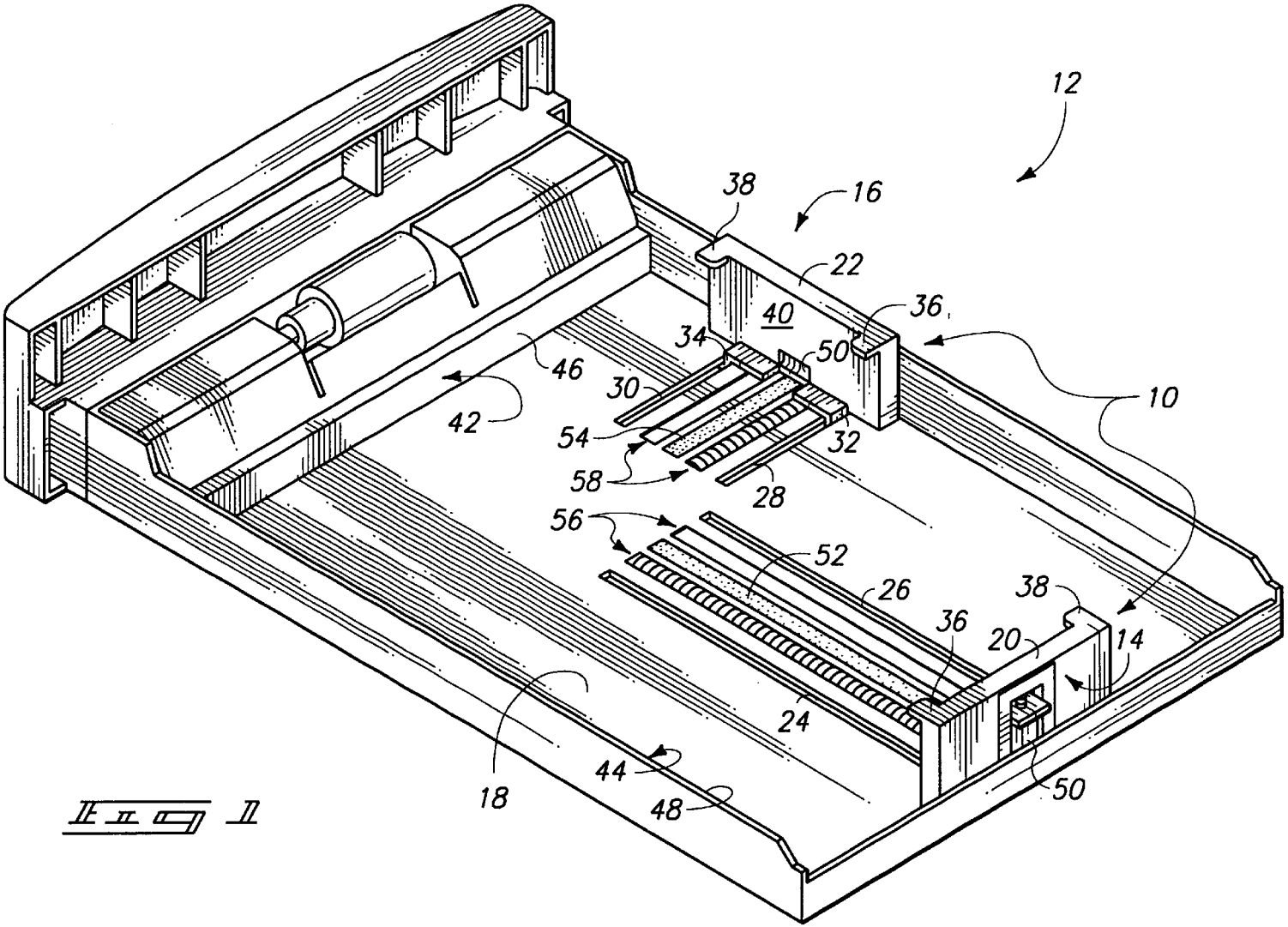
FIG. 1 is a perspective view of a preferred embodiment paper tray having a media size detector in accordance with one aspect of the present invention.

This disclosure of the invention is submitted in furtherance of the constitutional purposes of the U.S. Patent Laws "to promote the progress of science and useful arts". U.S. Constitution, Article 1, Section 8.

An apparatus and method for detecting media size when supplying media to a document-generating device is described. In the following description, numerous specific details are set forth for one specific implementation, as used on a print tray for a print device in order to provide a thorough understanding of the present invention. It will be apparent, however, to one skilled in the art that the present invention may be practiced without these specific details. In other instances, well-known methods and structural components are not described in detail in order to not obscure the present invention. It is understood that the present invention is comprised of paper tray components, some of which are readily manufacturable using well-known technology.

The present invention addresses an inherent problem of detecting media size when provided on a support surface, such as a paper tray, to a document-generating device, such as a printer. More particularly, media that does not fit standard sizes typically offered to a document-generating device are capable of being detected according to Applicant's invention. Historically, users have had to either use a multipurpose tray input, which causes throughput speed penalties because every piece of paper, or media, is assumed to have the longest possible length. Alternatively, users have historically been required to use a custom input tray, where the user manually enters the dimensions of the media that are being presented to the device. However, for general use such technique is cumbersome, at best. Accordingly, the automatic sensing technique of Applicant's invention enables size determination of any loaded media, which provides a better solution. With this terminology and historical perspective defined, the method and apparatus of the present invention for addressing the problem of detecting media size when loaded onto a support surface, or paper tray, are now discussed.

The present invention is not limited to a specific embodiment illustrated herein. A media size detector according to Applicant's invention is described below with reference to FIG. 1 and identified by reference numeral 10. Media size detector 10 is shown in one embodiment implemented on a paper tray 12 which forms a media-holding apparatus. Paper tray 12 is configured to receive media having a generally square or rectangular planar configuration, as is typically used when forming sheets of paper or documents. Media size detector 10 includes a longitudinal size detector, or sensor, 14 and a lateral size detector, or sensor, 16. A stack of media, or paper, is received on support surface 18 where it is placed by a user in abutment with back stop 20 and side stop 22.

As shown in FIG. 1, longitudinal size detector 14 is formed by back stop 20 which is slidably supported, or supported for sliding motion, on tray 12 for adjustable positioning at an infinite number of locations along slots 24 and 26. Similarly, side stop 22 is slidably supported on tray 12 by slots 28 and 30 for adjustable positioning along an infinite number of locations extending along slots 28 and 30.

Tray 12 comprises a media holding apparatus that may be removably received by a document-generating device, such as a printing device or printer, a copier, or a facsimile machine. Optionally, tray 12 can be secured to the document-generating device so as form a drawer, shelf or other receptacle. Additionally, such tray 12 can be utilized with a multi-function peripheral device (MFP). In operation, tray 12 is removed by a user from such device, and a fresh stack of paper is loaded onto support surface 18 by sliding the stack of paper into biased engagement with guide surfaces 46 and 48. Subsequently, back stop 20 is slid into contact with the stack of paper by upwardly biasing a locking shoe 50 on back stop 20 which enables slidable movement of back stop 20 along slots 24 and 26 until back stop 20 engages with such stack of paper. Similarly, side stop 22 is moved by upwardly biasing locking shoe 50 and sliding side stop 22 until guide surface 40 of side stop 22 engages a lateral edge of such stack of paper. Accordingly, the distance between back stop 20 and guide surface 46 matches the length of the stack of paper, and the distance between side stop 22 and guide surface 48 matches the width of the stack of paper. Once stops 20 and 22 are engaged with the stack of paper, respective shoes 50 are released which spring biases shoes 50 into frictionally engaging contact with the topmost surface of the paper tray 12, causing stops 20 and 22 to be securely fixed thereto.

After completing the above loading procedure, tray 12 is reloaded into the document-generating device where an electrical connection is made with the circuitry depicted in FIG. 7. A media size determination is made via longitudinal size detector 14 and lateral size detector 16 by detecting the position of back stop 20 and side stop 22. Accordingly, a determination can be made as to the size of paper that has been loaded into tray 12.

Figure 2:
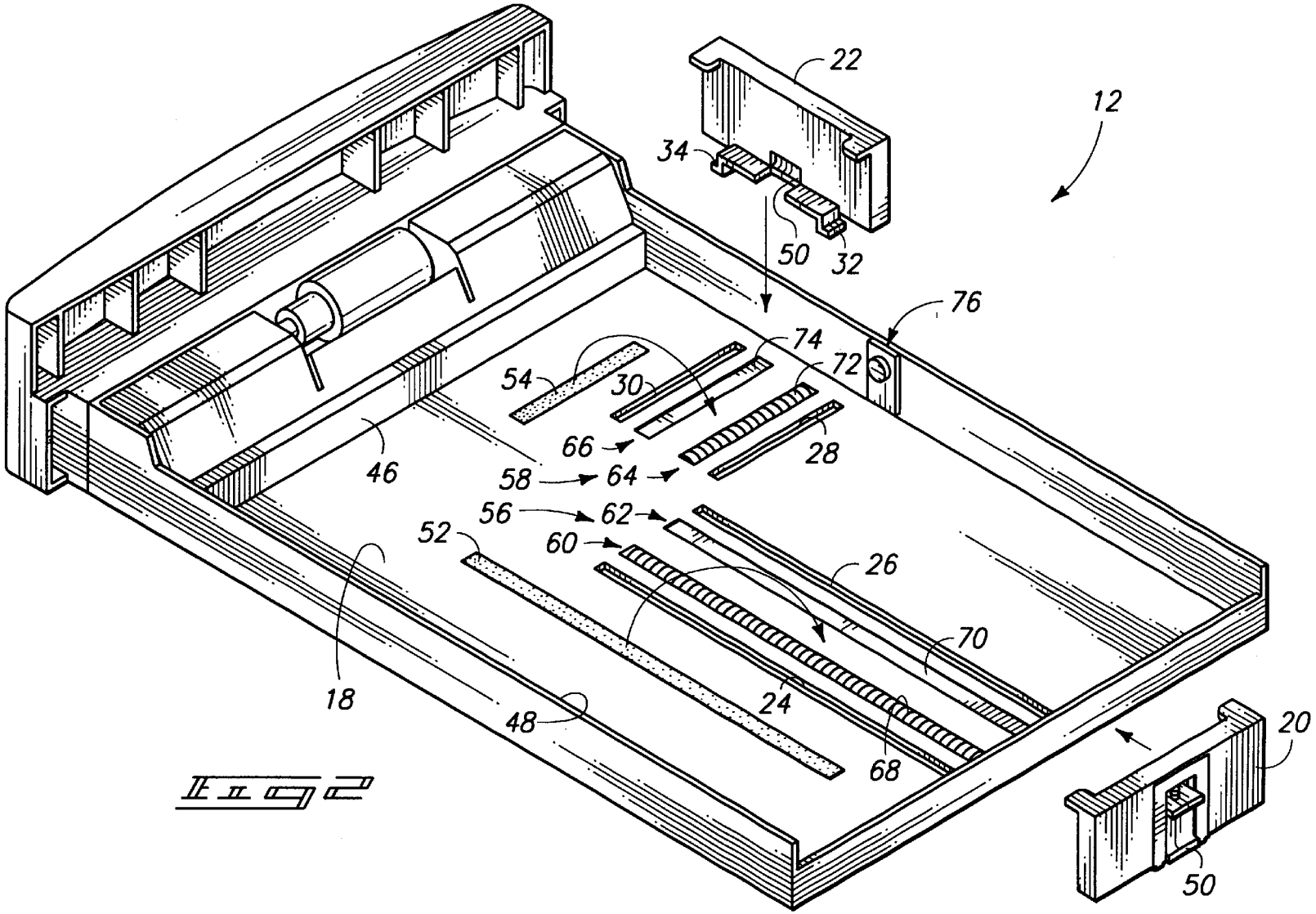
FIG. 2 is a partially exploded perspective view of the paper tray of FIG. 1.
Figure 5:
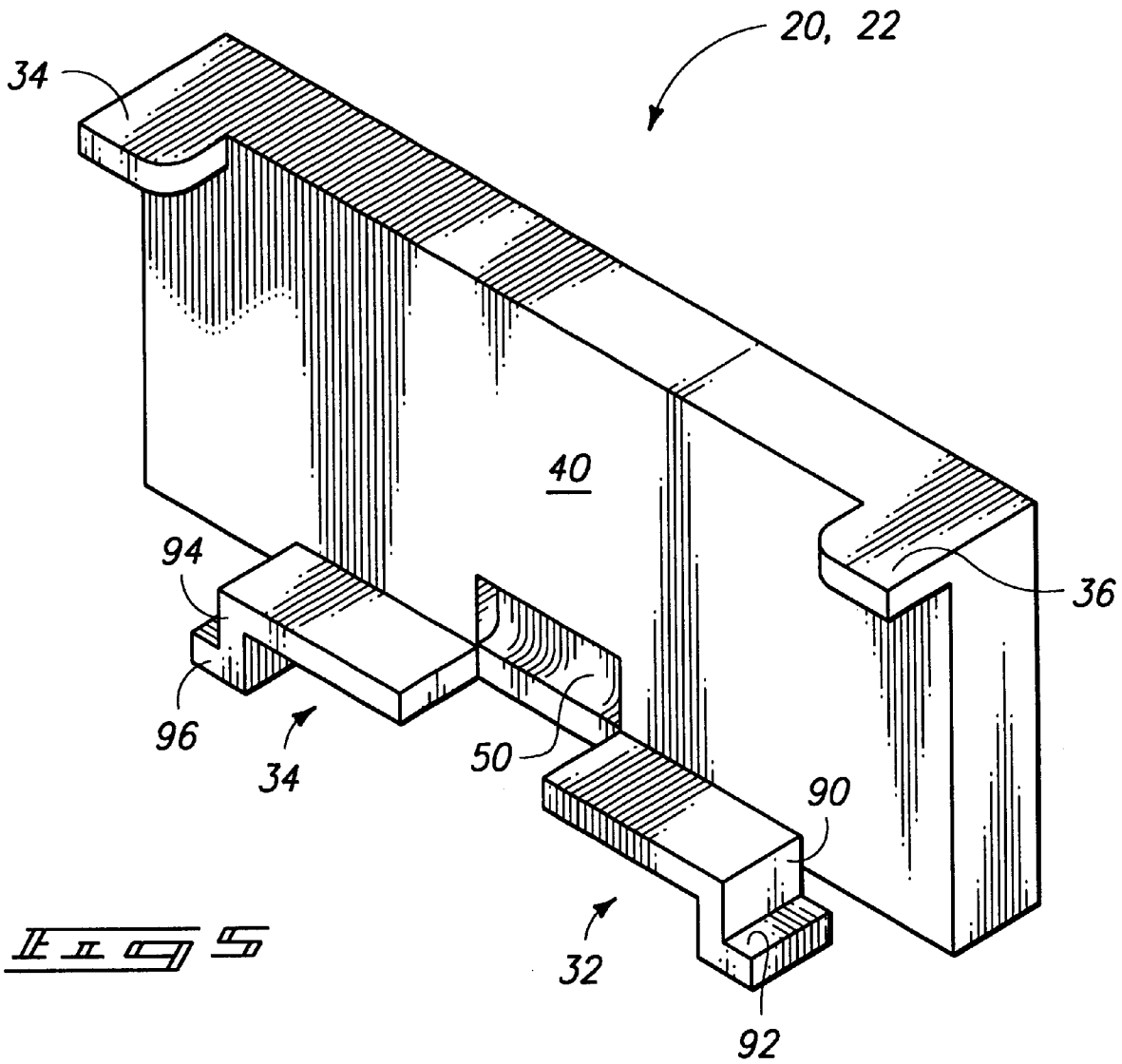
FIG. 5 is an enlarged perspective view taken from above and in front showing the media stop of FIG. 4.
Figure 11:
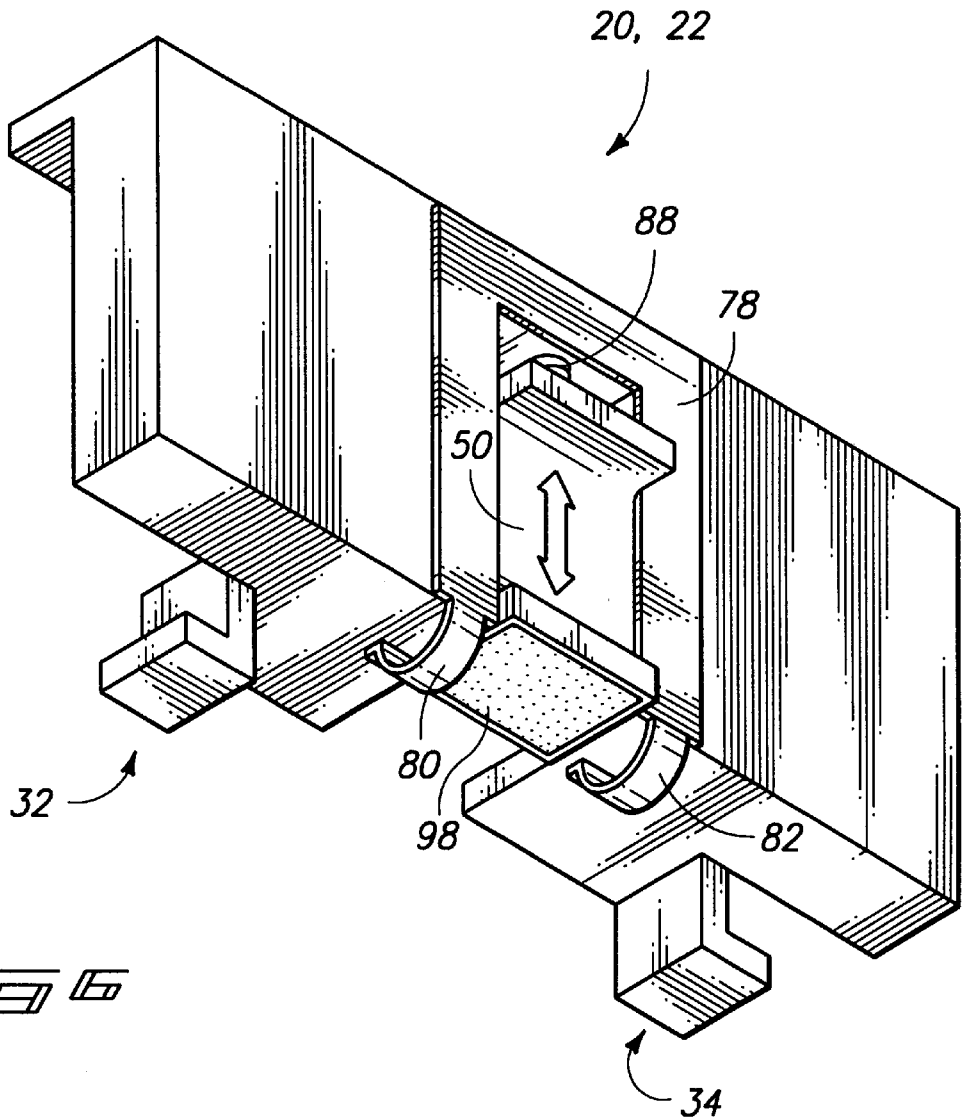
Figure 11:
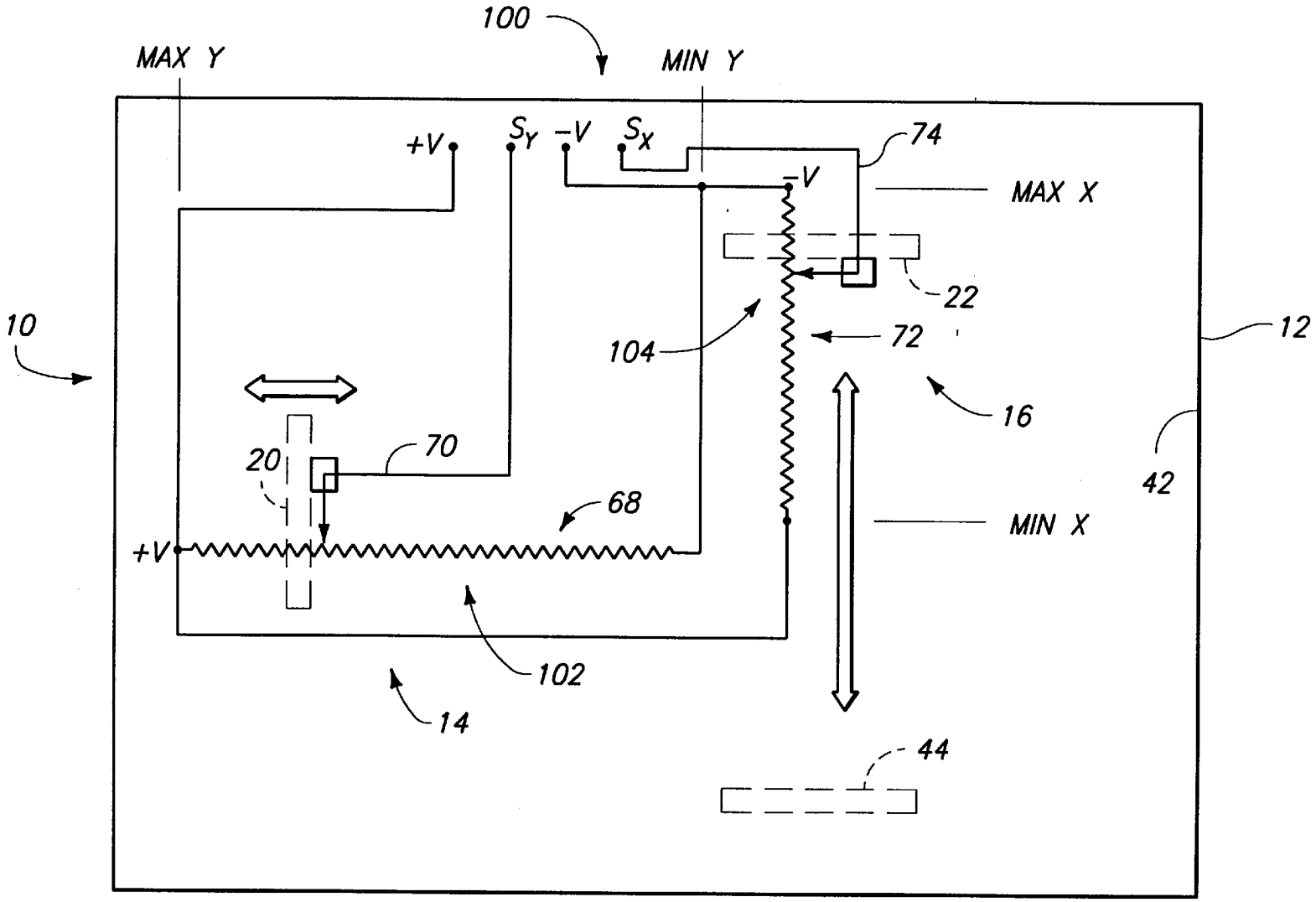

As shown in FIGS. 1 and 2, back stop 20 and side stop 22 are constructed the same. FIGS. 4–6 illustrate the construction of stops 20, 22 in even greater detail as discussed below. Each of stops 20 and 22 contains a pair of guide arms 32 and 34 which are received in associated slots 24, 26 and 28, 30, respectively. Arms 32 and 34 enable slidable support of stops 20 and 22 within slots 24, 26 and 28, 30, respectively.

As will be discussed below in greater detail, locking shoe 50 is downwardly biased when released in a resting state which causes shoe 50 to be engaged with support surface 18. The resulting frictional engagement prevents movement of stops 20 and 22, respectively. Upward biased movement of locking shoe 50 eliminates frictionable engagement between stops 20, 22 and support surface 18, respectively, which enables slidable movement of stops 20 and 22 along support surface 1 8 when readjusting and sizing a new stack of paper.

In order to enhance the frictionable engagement between each of stops 20 and 22, and with support surface 18, individual frictionable adhesive strips 52 and 54 are adhesively bonded to support surface 18 for engagement with respective locking shoes 50. One such suitable frictionable adhesive strip comprises a strip of non-skid material such as 3M marine protective tape sold by the Marine Trades Department of 3M Company, St. Paul, Minn., and comprising non-skid, adhesive-backed, anti-slip products. Such products comprise a grit-based or abrasive material, similar to sandpaper, that is contained within a protective coating and formed into a tape-like material having an adhesive backing for application to a surface. Alternatively, support surface 18 can be imparted with a roughened surface, such as a machined surface, sand-blasted surface, or etched surface, which imparts frictionable engagement with locking shoe 50 so as to prevent movement of stops 20 and 22 when received in a resting state there against. Optionally, surface 18 can be molded in place.

Stops 20 and 22 also include a pair of fingers 36 and 38 which limit the amount of paper that is loaded into paper tray 12 and which contain and support such paper therebelow.

As shown in FIG. 1, guide surfaces 46 and 48 are formed directly from integrally molded components comprising tray 12. Guide surface 46 provides a front stationary guide, or stop, 42 for receiving a stack of paper, and guide surface 48 provides a similar, perpendicular side stationary guide, or stop, 44 for receiving such stack of paper. Upon loading such stack of paper and moving stops 20 and 22 into engagement therewith, the longitudinal edges of such paper are engaged between guide 42 and back stop 20, and the lateral sides of such paper are engaged between guide 44 and side stop 22.

Figure 3:
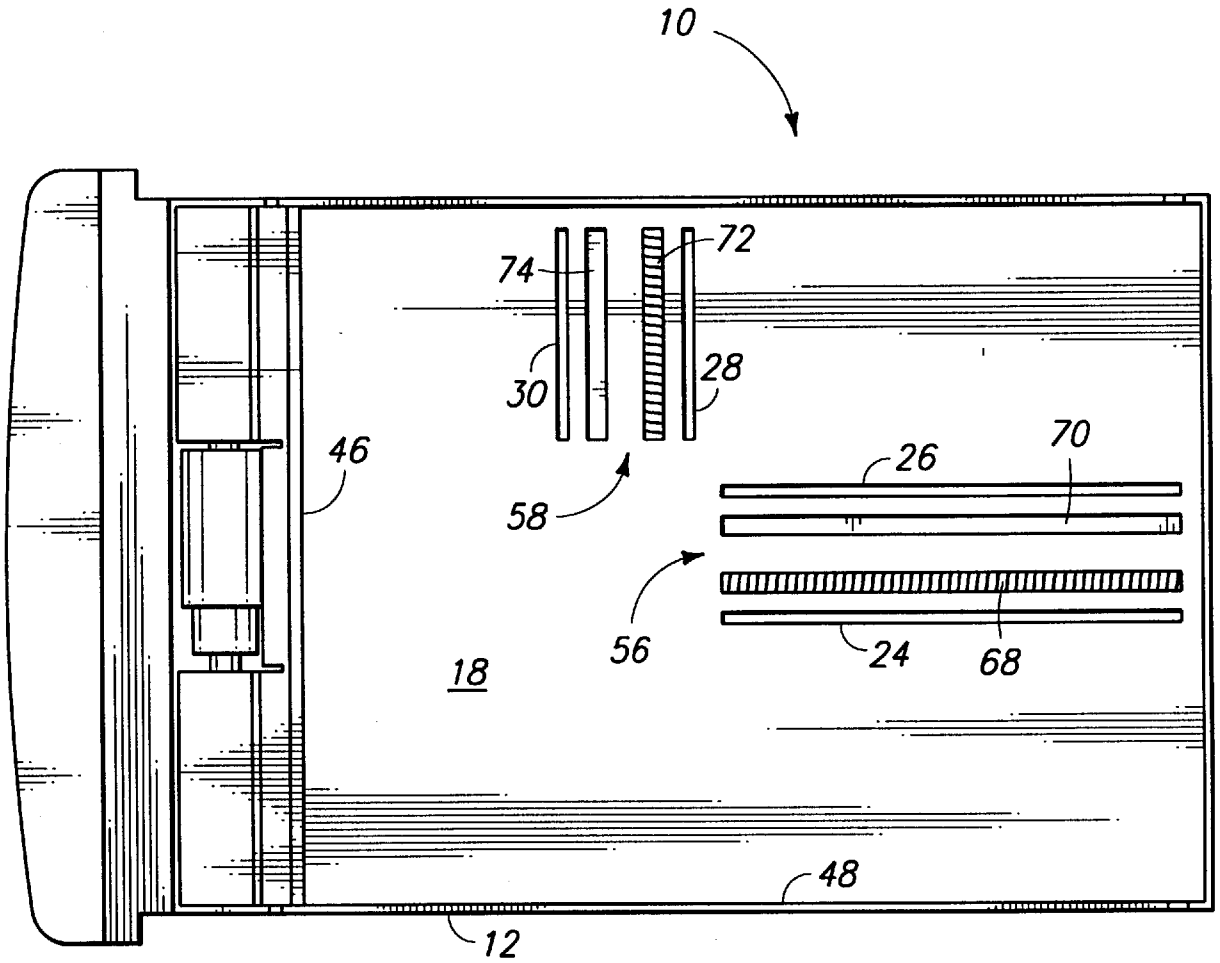
FIG. 3 is a top view of the paper tray of FIG. 1 showing the relationship of adjustable resistance components for the media size detector.
Figure 11:
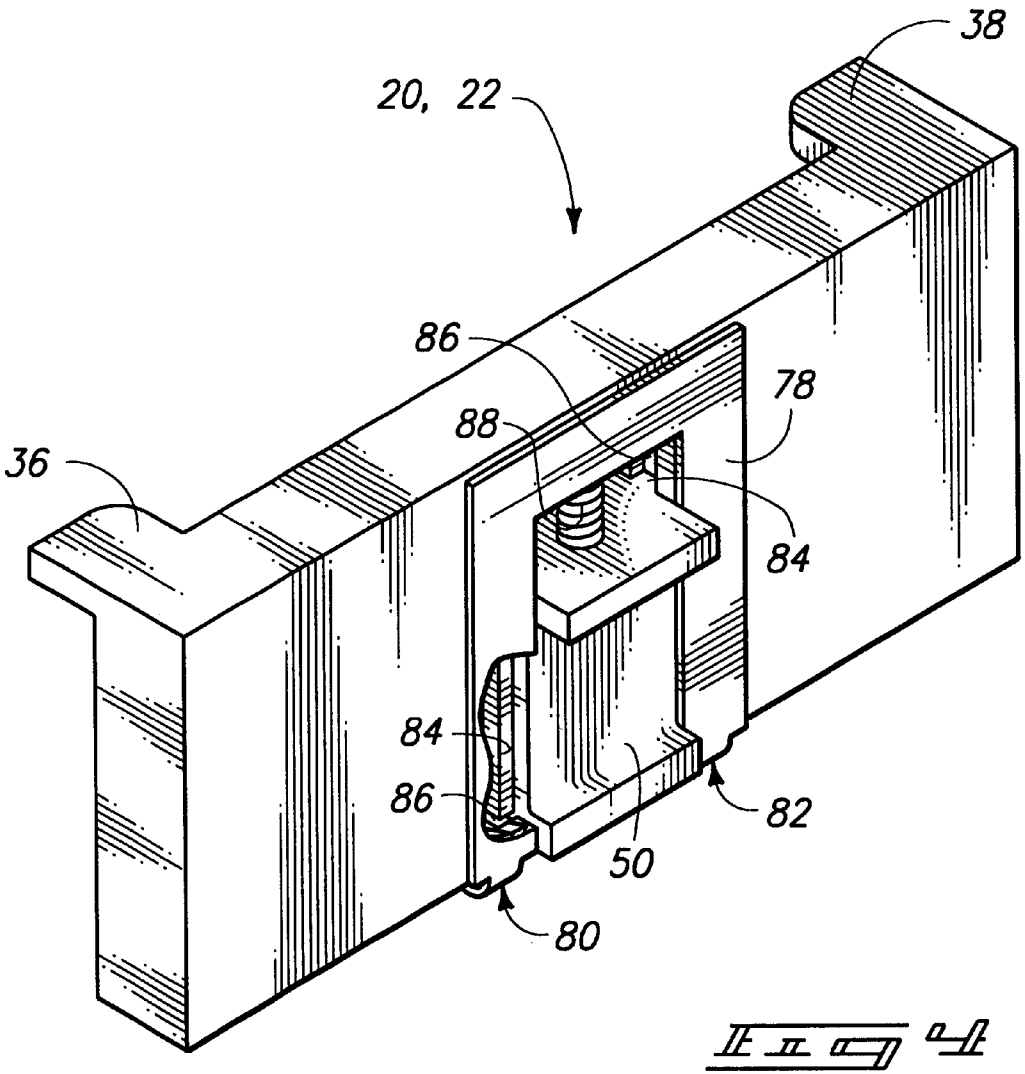

According to the construction depicted in FIG. 1, longitudinal size detector 14 and lateral size detector 16 each comprise a voltage divider circuit that includes an adjustable resistance component 56 and 58, respectively. As shown in FIGS. 2 and 3, adjustable resistance components 68, 72 and conductive strips 70, 74 electrically communicate via back stop 20 and side stop 22, respectively.

As shown in FIG. 2, adjustable resistance component 56 is formed by linear potentiometer 68 and conductive strip 70, which are electrically joined together by a conductive bridge strip 78 (see FIG. 4) provided on stop 20. Similarly, adjustable resistance component 58 is formed by linear potentiometer 72 and conductive strip 74, which are joined together by such conductive bridge strip on side stop 22.

In order to facilitate the presentment of a smooth and flat support surface 18, surface 18 comprises a top surface within tray 12, with a bottom surface being provided therebelow such that support surface 18 comprises an elevated false bottom in tray 12 in which potentiometer 68, 72 and conductor strip 70, 74 reside therein.

As shown in FIG. 2, slots 60, 62 and 64, 66 are provided in upper support surface 18, and potentiometer 72, strip 74 and potentiometer 68, strip 70 are supported beneath the slots, respectively. It is understood that potentiometers 68, 72 and strips 70, 74 are provided within slots 60–66 in a slightly recessed manner such that back stop 20 and side stop 22 can be slidably supported for movement by support surface 18. As will be described below in greater detail, a conductive bridge strip, or electrically conductive connection, 78 (see FIG. 4) is provided on the underside of back stop 20 and side stop 22 in order to make electrical connection between associated potentiometers 68, 72 and conductive strips 70, 74, respectively. The formation of such electrical contact forms a voltage divider that enables detection of the positioning for stops 20 and 22 by a print generation device in which tray 12 has been received. Additionally shown in FIG. 2, a pair of pins 76 is provided for supporting a spring loaded bottom feed tray (not shown) on top of which a stack of media is supported. The construction of such feed tray is well known in the art, and is omitted here since it does not directly pertain to implementation of Applicant's invention.

As shown in FIG. 3, the layout of slots 24–30 and adjustable resistance components 56 and 58 can be seen within support surface 18 of tray 12. More particularly, the layout of linear potentiometers 68, 72 and conductor strips 70, 74 enables the automatic sensing of paper size via placement of the back stop and side stop along adjustable resistance components 56 and 58, respectively. Hence, accurate sensing of media size can be provided in a paper feeding direction and in a transverse direction perpendicular to the feed direction. The ability to accurately sense the length of paper provided in tray 12 allows a printer to make paper feed adjustments that maintain a maximum throughput of paper when drawing a supply of paper from tray 12.

If, for instance, the media size of a sheet of paper is sensed as being longer than it actually is, the inter-page spacing between adjacent pages will be too large, which will reduce paper throughput and print time. Conversely, if the media is sensed too short, the inter-page spacing between sheets of paper may not be enough to avoid inadvertently feeding multiple pages sequentially for a single page being printed.

The same problem occurs with accurately detecting the width of media in the transverse direction. For the case of a laser printer having multiple heater bulbs within a fusing unit, the ability to achieve consistent roller temperature is very important. The consistency of roller temperature is quite sensitive to where media actually travels through the hot roller, due to the control algorithms that are used to govern how heat is applied to the roller and media. In the case of other types of devices, the objective may be to limit any tendency to print off the edge of the media and onto a roller. In either case, it is desirable to realize accurate sensing of media size in order to enhance device performance.

FIGS. 4–6 illustrate in greater detail the construction of back stop 20 and side stop 22. It is understood that back stop 20 and side stop 22 are constructed in essentially the same manner. For purposes of describing the invention, the construction of back stop 20 and side stop 22 is illustrated in FIGS. 4–6 as being identical.

As shown in FIG. 4, stops 20, 22 are each formed from a piece of molded plastic material from which fingers 36 and 38 are integrally molded. Locking shoe 50 is carried in stops 20, 22 within a recess. Locking shoe 50 includes a pair of vertically extending and exposed tongues 84 that are received within complementary grooves 86 of stops 20, 22. A coil compression spring 88 is carried on a topmost portion of shoe 50 such that shoe 50 is downwardly biased via coaction of spring 88 when left in a resting state. A user need only upwardly bias locking shoe 50 with a finger, compressing spring 88, when movably positioning stops 20, 22 within a tray. Preferably, the top surface on shoe 50 and a corresponding surface on stops 20, 22 each form a nipple over which each end of spring 88 is received so that spring 88 is entrapped and held between shoe 50 and stops 20, 22. Preferably, grooves 86 terminate at a bottom-most location so as to prevent ejection of shoe 50 from stop 20, 22. One manner of terminating groove 86 comprises adhesively gluing an end plug at the bottom of grooves 86, following assembly of locking shoe 50 therein.

Also according to FIG. 4, a metal conductive bridge strip 78 is affixed to a rear face on stops 20 and 22. According to one implementation, conductive bridge strip 78 is adhesively bonded to stops 20 and 22. Alternatively, strip 78 is secured with fasteners to the back surface of stops 20 and 22, or snap-fit into place with complementary surface features that interfit. Strip 78 includes a pair of flexible, spring-like terminating fingers 80 and 82 which, in assembly, maintain slidable, electrical contact with adjustable resistance components 56 and 58 (of FIG. 2). More particularly, fingers 80 and 82, as shown in FIG. 6, maintain contact with one of potentiometers 68, 70 and conductive strips 70, 74 as shown in FIGS. 1 and 2.

FIG. 5 illustrates stops 20, 22 from a front side that shows guide surface 40. Locking shoe 50 can be seen in a lowered, resting state which maintains frictionable contact with one of strips 50, 52 as shown in FIG. 1. Additionally, the construction of guide arms 32 and 34 is clearly shown in FIG. 5. Arms 32 and 34 comprise a vertical finger 90, 94 and a horizontal finger 92, 96, respectively. Vertical fingers 90 and 94 are configured to pass through slots 24, 28 and 26, 30, respectively. Likewise, horizontal fingers 92, 96 are configured to extend laterally of slots 24, 28 and 26, 30, respectively, so as to retain stops 20 and 22 within such slots.

In order to facilitate assembly, preferably guide arms 32 and 34 are each formed from a somewhat rigid, but slightly flexible, plastic material which enables assembly by mechanically urging horizontal fingers 92 and 96 towards one another to facilitate insertion within slots 24, 28 and 26, 30 during assembly.

FIG. 6 illustrates a lower, rearmost view of stops 20 and 22 in a manner that shows the sprung positioning of fingers 80, 82 and the resting position of locking shoe 50 shown in a lowermost position. Locking shoe 50 includes a rubber surface pad 98. Pad 98 is configured to frictionably and securely engage with one of adhesive strips 52 and 54 (of FIG. 1) so as to ensure rigid securement of stops 20 and 22 within a paper tray. Upward biasing of shoe 50 disengages rubber surface pad 98 from such frictionable adhesive strips which facilitates slidable movement of back stop 20 and side stop 22 within a tray during alignment and abutment of such stops in engagement with a stack of media being sized within a tray.

FIG. 7 depicts a simplified schematic diagram of media size detector 10 used on paper tray 12 of FIGS. 1–6. FIG. 7 comprises a simplified view taken from beneath a paper tray, showing the layout of longitudinal size detector 14 and lateral size detector 16 within the bottom of paper tray 12. The minimum and maximum displacement values for back stop 20 and side stop 22 are indicated by MIN X, MIN Y and MAX X, MAX Y, respectively. Linear potentiometers 68 and 72 and conductive strips 70 and 74 are shown in simplified form, with the conductive bridge strip on back stop 20 and side stop 22 forming an electrical bridge connection therebetween. A 4-pin electrical connection, or connector, 100 is provided for connecting media size detector 10 with a document-generating device, or printer.

The longitudinal size detector 14 and lateral size detector 16 of media size detector 10 each form a voltage divider circuit 102 and 104, respectively. Such voltage divider circuits 102 and 104 provide automatic sensing of media size. One end of travel for each voltage divider circuit 102 and 104 corresponds with the lower bound of supported media size for the corresponding direction being detected. The other end of travel senses the upper bound of supported media size. Voltage divider circuit 102 detects media size in the paper feed direction, and voltage divider circuit 104 detects media size in a transverse direction.

It is not necessary that linear potentiometers 68 and 72 (of FIG. 1) be highly accurate, so long as the resistance is consistent throughout the length of travel of stops 20 and 22, respectively, there along. Alternatively, a multipleturn rotary potentiometer can be used with gears, cables, or other means used to couple the potentiometer to the traveling member or stop. Further alternatively, a custom adjustable potentiometer can be used that is capable of being adjusted in resistance such that the smallest and largest supported media sizes correspond with the extreme ends of the complete range of the voltage applied to each voltage divider.

Connection 100 includes two inputs and two outputs; namely +V,−V and $S_x$, $S_y$, respectively. A power supply and a voltage sensing circuit (not shown) are provided within the printing device, or printer, with the voltage sensing circuit connecting with connection 100 when the paper tray is loaded into the printer. The voltage sensing circuit compares the voltage applied by a power supply with the divided voltage, then calculates the media size. One type of power supply comprises a printing device power supply. Another type of power supply comprises a battery. Preferably, a four-contact connector is used to connect connection 100 with the printer. Once media tray 12 is assembled, all that is needed is a two-point calibration in order to ensure proper sensing.

Optionally, stationary guides 42 and 44 can be constructed in the same manner as back stop 20 and side stop 22, with each stop including a respective size detector having a linear potentiometer. Accordingly, the relative positioning of each stop and guide can be compared to determine the size of media placed therebetween.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A media holding apparatus, comprising:

a tray having a support surface configured to receive media;

a frictionable surface provided on the tray;

a media stop carried by the tray for engagement with the frictionable surface, the media stop movably supported for continuously adjustable positioning relative to the tray to conform dimensionally with media received in the tray by retracting the media stop from the frictionable surface; and a position-detecting sensor including a voltage divider circuit comprising an adjustable resistance component associated with the tray and the media stop and operative to generate a unique electrical pattern corresponding to a detected position of the media stop relative to the tray, the unique electrical pattern indicative of the size of the media detected in the tray.

2. The apparatus of claim 1 wherein the adjustable resistance component comprises a linear potentiometer and a conductive strip.

3. The apparatus of claim 2 wherein the movable media stop comprises a conductive bridge strip including a pair of conductive tabs configured to maintain slidable electrical contact with the potentiometer and the conductive strip.

4. A media holding apparatus, comprising:

a tray having a support surface configured to receive media;

a frictionable surface provided on the tray;

a media stop having a retractable locking shoe, the media stop carried by the tray and movably supported for continuously adjustable positioning relative to the tray when retracting the locking shoe from the frictionable surface; and a position-detecting sensor including a voltage divider circuit comprising an adjustable resistance component associated with the tray and the media stop and operative to generate a unique electrical pattern corresponding to a detected position of the media stop relative to the tray, the unique electrical pattern indicative of the size of the media detected in the tray;

wherein the position-detecting sensor comprises a potentiometer and a conductive strip, and wherein the potentiometer and the conductive strip are carried by the tray and communicate electrically via the adjustably positioned media stop.

5. The apparatus of claim 1 wherein the media stop comprises a retractable shoe engagable with the frictionable surface to engage the stop with the tray and retractable away from the frictionable surface when moving the media stop relative to the tray so as to conform dimensionally with media received in the tray.

6. The apparatus of claim 5 wherein the shoe comprises a locking shoe comprising a rubber surface pad configured to frictionably and securely engage with the frictionable surface upon release of the shoe into engagement with the frictionable surface.

7. A media holding apparatus, comprising:

a tray having a support surface configured to receive media;

a media stop having a retractable shoe, the media stop carried by the tray and movably supported for continuously adjustable positioning relative to the tray when retracting the shoe from the frictionable surface; and a frictionable adhesive strip adhered to one of the tray and the shoe;

a position-detecting sensor including a voltage divider circuit comprising an adjustable resistance component associated with the tray and the media stop and operative to generate a unique electrical pattern corresponding to a detected position of the media stop relative to the tray, the unique electrical pattern indicative of the size of the media detected in the tray;

wherein the voltage divider comprises a linear potentiometer, a conductive strip and a conductive bridge strip, wherein the conductive strip and the linear potentiometer are carried by the support member, and wherein the conductive bridge strip is carried by the media stop in movable contact with both the conductive strip and the linear potentiometer.

8. A method for detecting the size of media placed within a tray of a document-generating device, comprising the steps of:

providing an infinitely adjustable movable media stop on a support surface;

providing a voltage divider having a bridge connection carried by the movable media stop;

loading media onto the support surface;

moving the media stop to contain the media and to conform with a dimension of the media; and detecting the size of the contained media by monitoring the voltage drop across the voltage divider to determine the position of the media stop on the support surface.

9. The method of claim 8 wherein the voltage divider comprises a linear potentiometer, and wherein the step of moving the media stop comprises moving the bridge connection of the media stop along the linear potentiometer so as to adjust voltage output of the voltage divider.

10. The method of claim 8 wherein the media stop comprises a back stop supported for continuously adjustable, slidable positioning along the support surface.

11. The method of claim 8 wherein the media stop comprises a side stop supported for continuously adjustable, slidable positioning along the support surface.

12. The method of claim 8 wherein the step of detecting the size of the contained media comprises detecting a voltage output from the voltage divider indicative of the position of the media stop on the support surface conforming with a dimension of the media.

* * * * *